US008701757B2

(12) United States Patent
Greci

(10) Patent No.: US 8,701,757 B2
(45) Date of Patent: Apr. 22, 2014

(54) SAND CONTROL SCREEN ASSEMBLY HAVING A COMPLIANT DRAINAGE LAYER

(75) Inventor: Stephen Michael Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 503 days.

(21) Appl. No.: 12/971,959

(22) Filed: Dec. 17, 2010

(65) Prior Publication Data

US 2012/0152528 A1 Jun. 21, 2012

(51) Int. Cl.
*E03B 3/18* (2006.01)

(52) U.S. Cl.
USPC ..... 166/227; 166/230; 166/231; 166/233

(58) Field of Classification Search
USPC ..... 166/227–230, 233
See application file for complete search history.

(56) References Cited

U.S. PATENT DOCUMENTS 5,311,942 A * 5/1994 Nagaoka ..... 166/232
5,339,895 A * 8/1994 Arterbury et al. ..... 166/227
5,476,143 A * 12/1995 Sparlin et al. ..... 166/233
5,664,628 A 9/1997 Koehler et al.
5,829,522 A 11/1998 Ross et al.
5,931,232 A 8/1999 Echols et al.
5,938,925 A 8/1999 Hamid et al.
6,092,604 A 7/2000 Rice et al.
6,125,932 A 10/2000 Hamid et al.
6,776,241 B2 8/2004 Castano-Mears et al.
7,451,815 B2 11/2008 Hailey, Jr.
2003/0000700 A1* 1/2003 Hailey, Jr. ..... 166/278
2007/0119590 A1* 5/2007 Michel ..... 166/278
2008/0283239 A1* 11/2008 Langlais et al. ..... 166/230
2010/0258300 A1 10/2010 Shoemate
2011/0108477 A1* 5/2011 Hammer ..... 210/499

OTHER PUBLICATIONS

International Search Report and Written Opinion (PCT/US2011/062231), KIPO (Jul. 23, 2012).

* cited by examiner

*Primary Examiner* — James Sayre
(74) *Attorney, Agent, or Firm* — Lawrence R. Youst

(57) ABSTRACT

A sand control screen assembly (300) includes a base pipe (302) having at least one opening in a sidewall thereof and a screen jacket positioned about the base pipe (302). The screen jacket includes a drainage layer (304) and a filter medium positioned about the drainage layer (304). The drainage layer (304) includes a plurality of circumferentially distributed axially extending ribs (306) and a wrap wire (308) positioned around the ribs (306) forming a plurality of turns having gaps therebetween. The ribs (306) includes a plurality of first ribs (310) having a first cross-sectional rib profile, shaped and sized to maintain an annular space between the wrap wire (308) and the base pipe (302) and a plurality of second ribs (312) having a second cross-sectional rib profile, shaped and sized to provide for a gap between the second ribs (312) and the base pipe (302).

8 Claims, 7 Drawing Sheets

SAND CONTROL SCREEN ASSEMBLY HAVING A COMPLIANT DRAINAGE LAYER

TECHNICAL FIELD OF THE INVENTION

This invention relates, in general, to equipment utilized in conjunction with operations performed in subterranean wells and, in particular, to a sand control screen assembly having a compliant drainage layer.

BACKGROUND OF THE INVENTION

Without limiting the scope of the present invention, its background will be described with reference to producing fluid from a hydrocarbon bearing subterranean formation, as an example.

Since the beginning of oil production from subsurface formations, the industry has been concerned with efficient control of the movement of unconsolidated formation particles, such as sand, into the wellbore. For example, such formation movement commonly occurs during production from completions in loose sandstone or following hydraulic fracture of a formation. Production of these materials causes numerous problems in the operation of oil, gas or water wells. These problems include plugged formations, tubing and subsurface flow lines, as well as erosion of casing, downhole equipment and surface equipment. These problems lead to high maintenance costs and unacceptable well downtime. Accordingly, numerous methods have been utilized to control the movement of these unconsolidated formation particles during the production of fluids.

In one such method, sand control screen assemblies are interconnected within the completion string. The sand control screen assemblies are designed to allow fluid flow therethrough but prevent the flow of particulate materials of a predetermined size from passing therethrough. There are numerous types of filter media that are used for such sand control screen assemblies including wire wrapped screens, prepacked screens, wire mesh screens and the like. It has been found that certain screen designs benefit from having a drainage layer between the filter medium and the base pipe of the sand control screen assembly. In one such design, the drainage layer may be formed using conventional wire wrap techniques wherein a wrap wire is wrapped around and welded to a plurality of longitudinally extending ribs such that the wrap wire forms a plurality of turns around the ribs having gaps therebetween. A multilayer wire mesh filter medium, preferably including a protective outer shroud, may be disposed around the wire wrapped drainage layer to form a sand control screen jacket which may be installed on the base pipe. Once installed on the base pipe, the ribs provide certain strength to the wire wrap and stand-off between the wire wrap and the base pipe for fluid cross flow.

It has been found, however, that such sand control screen assemblies have suffered from collapse failures in the wire mesh filter medium when the wrap wire of the drainage layer begins to spread apart and cannot adequately support the wire mesh at increased pressures. A primary cause of wrap wire spreading is wrinkling or buckling forming along the length of the wire wrap support structure which occurs as the wrap wire begins to conform to the outer diameter of the base pipe. Once wrap wire spreading occurs in the drainage layer, support is lost for the wire mesh filter medium which has led to tearing or other collapse damage to the wire mesh filter medium allowing particle infiltration therethrough.

Accordingly, a need has arisen for a sand control screen assembly that is capable of filtering fines out of a production stream from a subterranean hydrocarbon bearing formation. A need has also arisen for such a sand control screen assembly that is simple and cost-effective to manufacture and that is capable of withstanding severe downhole conditions during installation and operation. Further, a need has arisen for such a sand control screen assembly that does not suffer from collapse failures at increased pressures.

SUMMARY OF THE INVENTION

The present invention disclosed herein comprises a sand control screen assembly for preventing the inflow of formation particles during production. The sand control screen assembly of the present invention allows for compliant movement of a drainage layer under high-pressure conditions while maintaining the integrity of the underlying structure. In addition, the sand control screen assembly of the present invention is simple and cost-effective to manufacture and is capable of withstanding severe downhole conditions during installation and production.

In one aspect, the present invention is directed to a sand control screen assembly including a base pipe having at least one opening in a sidewall thereof and a screen jacket positioned about the base pipe. The screen jacket includes a drainage layer and a filter medium positioned about the drainage layer. The drainage layer includes a plurality of circumferentially distributed axially extending ribs and a wrap wire positioned around the ribs forming a plurality of turns having gaps therebetween. The ribs includes a plurality of first ribs having a first cross-sectional rib profile shaped and sized to maintain an annular space between the wrap wire and the base pipe and a plurality of second ribs having a second cross-sectional rib profile shaped and sized to provide for a gap between the second ribs and the base pipe.

In one embodiment, the screen jacket is positioned about a perforated section of the base pipe. In another embodiment, the screen jacket is positioned about a nonperforated section of the base pipe. In a further embodiment, the filter medium may be a wire mesh filter medium.

In one embodiment, the first ribs have a generally-trapezoidal cross-sectional rib profile and the second ribs have a circular cross-sectional rib profile. In another embodiment, the first ribs have a generally-trapezoidal cross-sectional rib profile and the second ribs have a rectangular cross-sectional rib profile. In certain embodiments, at least one second rib is circumferentially located between each adjacent pair of first ribs. In other embodiments, at least two second ribs are circumferentially located between each adjacent pair of first ribs.

In another aspect, the present invention is directed to a sand control screen assembly including a base pipe having at least one opening in a sidewall thereof and a screen jacket positioned about the base pipe. The screen jacket includes a drainage layer and a filter medium positioned about the drainage layer. The drainage layer includes a plurality of circumferentially distributed axially extending ribs and a wrap wire positioned around the ribs forming a plurality of turns having gaps therebetween. The ribs include a plurality of first ribs and a plurality of second ribs. The first ribs have a nominal diameter in the radial direction that is greater than a nominal diameter in the radial direction of the second ribs to provide for a gap between the second ribs and the base pipe.

In a further aspect, the present invention is directed to a screen jacket for positioning around a base pipe to form a sand control screen assembly. The screen jacket includes a plurality of circumferentially distributed axially extending ribs and a wrap wire positioned around the ribs forming a plurality of turns having gaps therebetween. The ribs include a plurality of first ribs and a plurality of second ribs. The first ribs have a nominal diameter in the radial direction that is greater than a nominal diameter in the radial direction of the second ribs.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
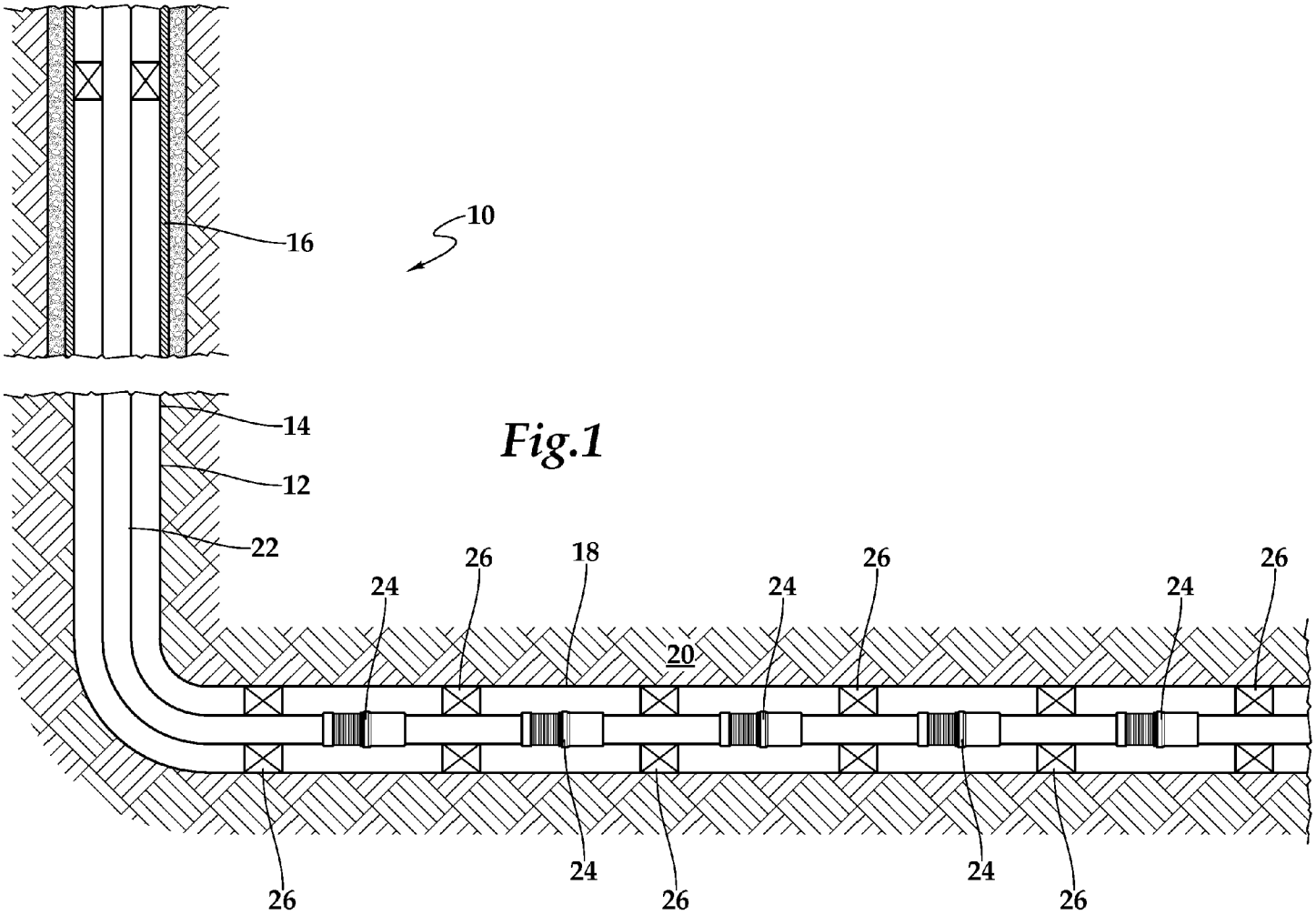
FIG. 1 is a schematic illustration of a well system operating a plurality of sand control screen assemblies according to an embodiment of the present invention.

Referring initially to FIG. 1, therein is depicted a well system including a plurality of sand control screen assemblies embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. At its lower end, tubing string 22 is coupled to a completions string that has been installed in wellbore 12 and divides the completion interval into various production intervals adjacent to formation 20. The completion string includes a plurality of sand control screen assemblies 24, each of which is positioned between a pair of packers 26 that provides a fluid seal between the completion string 22 and wellbore 12, thereby defining the production intervals. Sand control screen assemblies 24 serve the primary functions of filtering particulate matter out of the production fluid stream and may also include flow control capabilities or other additional functionality.

Even though FIG. 1 depicts the sand control screen assemblies of the present invention in an open hole environment, it should be understood by those skilled in the art that the present invention is equally well suited for use in cased wells. Also, even though FIG. 1 depicts one sand control screen assembly in each production interval, it should be understood by those skilled in the art that any number of sand control screen assemblies of the present invention may be deployed within a production interval without departing from the principles of the present invention. Further, even though FIG. 1 depicts each sand control screen assemblies as having a single screen jacket, it should be understood by those skilled in the art that any number of screen jackets may be installed on a single sand control screen assembly of the present invention without departing from the principles of the present invention.

In addition, even though FIG. 1 depicts the sand control screen assemblies of the present invention in a horizontal section of the wellbore, it should be understood by those skilled in the art that the present invention are equally well suited for use in deviated wellbores, vertical wellbores, multilateral wellbore and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
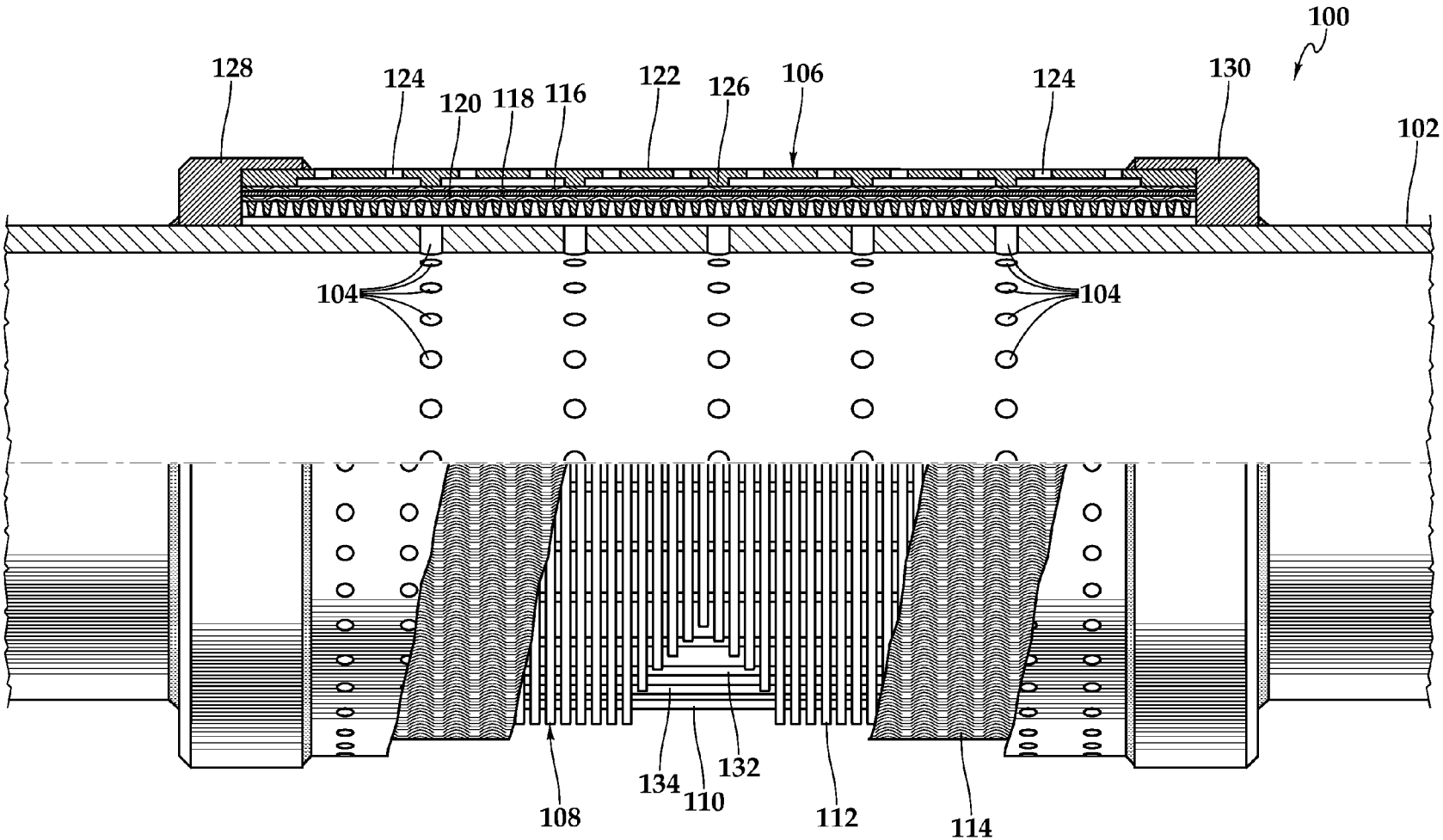
FIG. 2 is a quarter sectional view, partial cutaway, of a sand control screen assembly according to an embodiment of the present invention.

Referring next to FIG. 2, therein is depicted a quarter sectional view of a sand control screen assembly according to the present invention that is representatively illustrated and generally designated 100. Sand control screen assembly 100 may be suitably coupled to other similar sand control screen assemblies, production packers, locating nipples, production tubulars or other downhole tools to form a completions string such as that described above. Sand control screen assembly 100 includes a base pipe 102 that including a plurality of production ports or openings 104. Positioned around the illustrated portion of base pipe 102 is a screen jacket 106 that serves as a filter medium designed to allow fluids to flow therethrough but prevent particulate matter of a predetermined size from flowing therethrough. Even though FIG. 2 depicts sand control screen assembly 100 with a single screen jacket 106, those skilled in the art will recognize that the sand control screen assemblies of the present invention could have additional screen jackets positioned around additional perforated sections of a base pipe with departing from the principles of the present invention.

In the illustrated embodiment, screen jacket 106 includes a drainage layer 108 formed from a plurality of circumferentially distributed axially extending ribs 110 having a screen wire 112 wrapped around ribs 110 forming a plurality of turns having gaps therebetween. Drainage layer 108 provides stand-off for fluid cross flow between a wire mesh filter medium 114 and base pipe 102. Wire mesh filter medium 114 is preferably formed from a fluid-porous, particulate restricting, metal material such as a plurality of layers of a wire mesh that are sintered, diffusion bond or otherwise operably associated with one another to form a wire mesh screen. In the illustrated embodiment, wire mesh filter medium 112 has three wire mesh layers 116, 118, 120, however, those skilled in the art will recognize that wire mesh filter medium 114 could have other numbers of wire mesh layers both greater than or less than three without departing from the principles of the present invention.

Positioned around wire mesh filter medium 114 is a protective outer shroud 122 having an array of regularly-spaced perforations 124 passing therethrough. Outer shroud 122 also has a plurality of dimples 126 that provide stand-off between the inner surface of outer shroud 122 and the outer surface of wire mesh filter medium 114. In the illustrate embodiment, screen jacket 106 is attached to base pipe 102 by a pair of connector rings 128, 130 that are welded to outer shroud 122 and base pipe 102. Even though welded connections are depicted and described in FIG. 2, those skilled in the art will understand that connector rings 128, 130 could be coupled to outer shroud 122, base pipe 102 or both by other means including, but not limited to, mechanical connections, sand tight friction fit connections or the like.

The present invention is characterized in such a manner that the array of circumferentially distributed axially extending ribs 114 comprises at least a first set of ribs 132 having certain characteristics and a second set of ribs 134 having different characteristics. For example, the first set of ribs 132 may have a larger nominal diameter in the radial direction of sand control screen assembly 100 than the second set of ribs 134. As another example, the first set of ribs 132 may have a different cross sectional shape than the second set of ribs 134. Preferably, the first set of ribs 132 provides a different stand-off dimension than the second set of ribs 134, as described in further detail below.

Figure 3A:
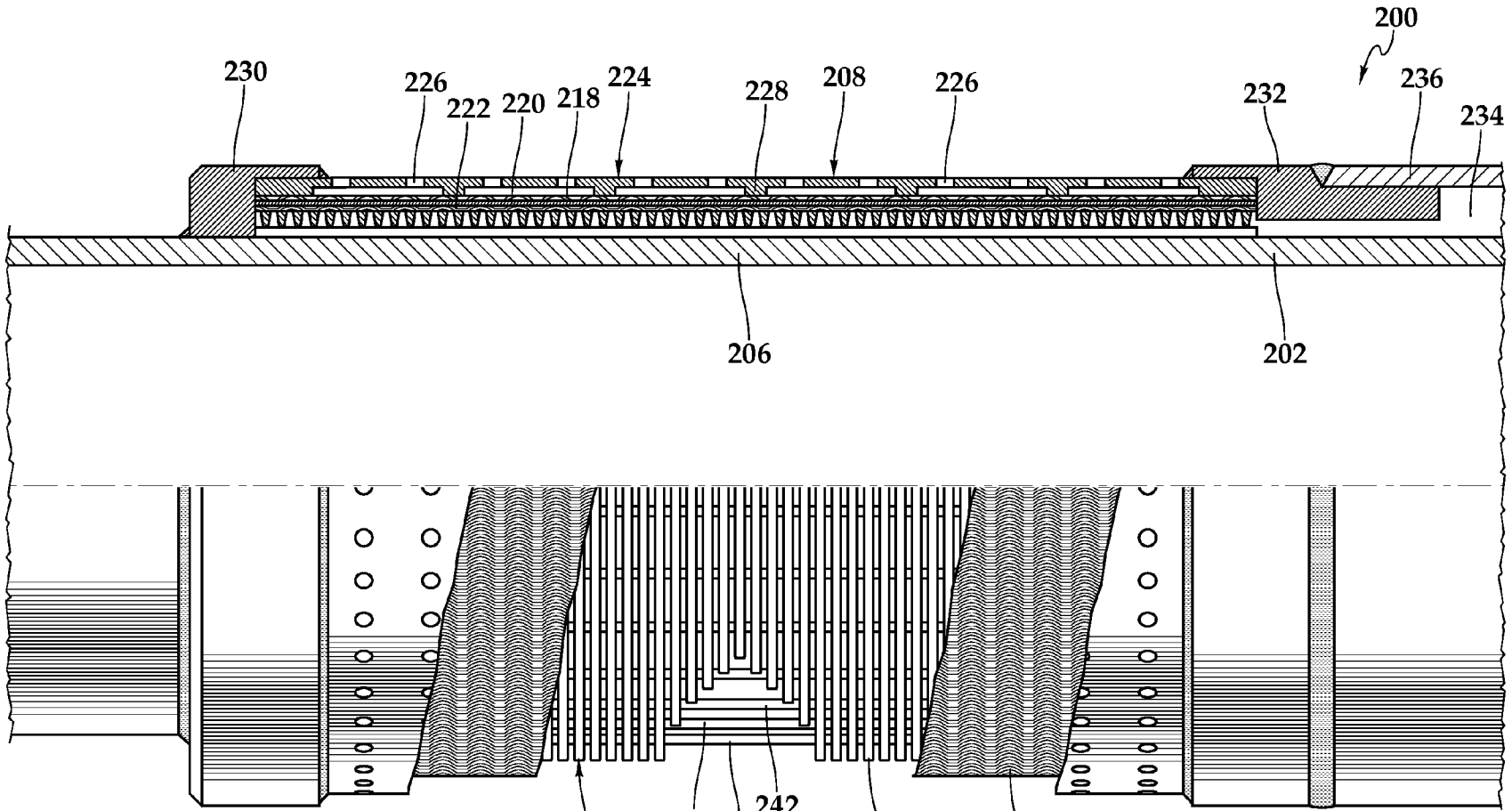
FIGS. 3A-3B are quarter sectional views of adjacent axial sections of a sand control screen assembly according to an embodiment of the present invention.
Figure 3B:
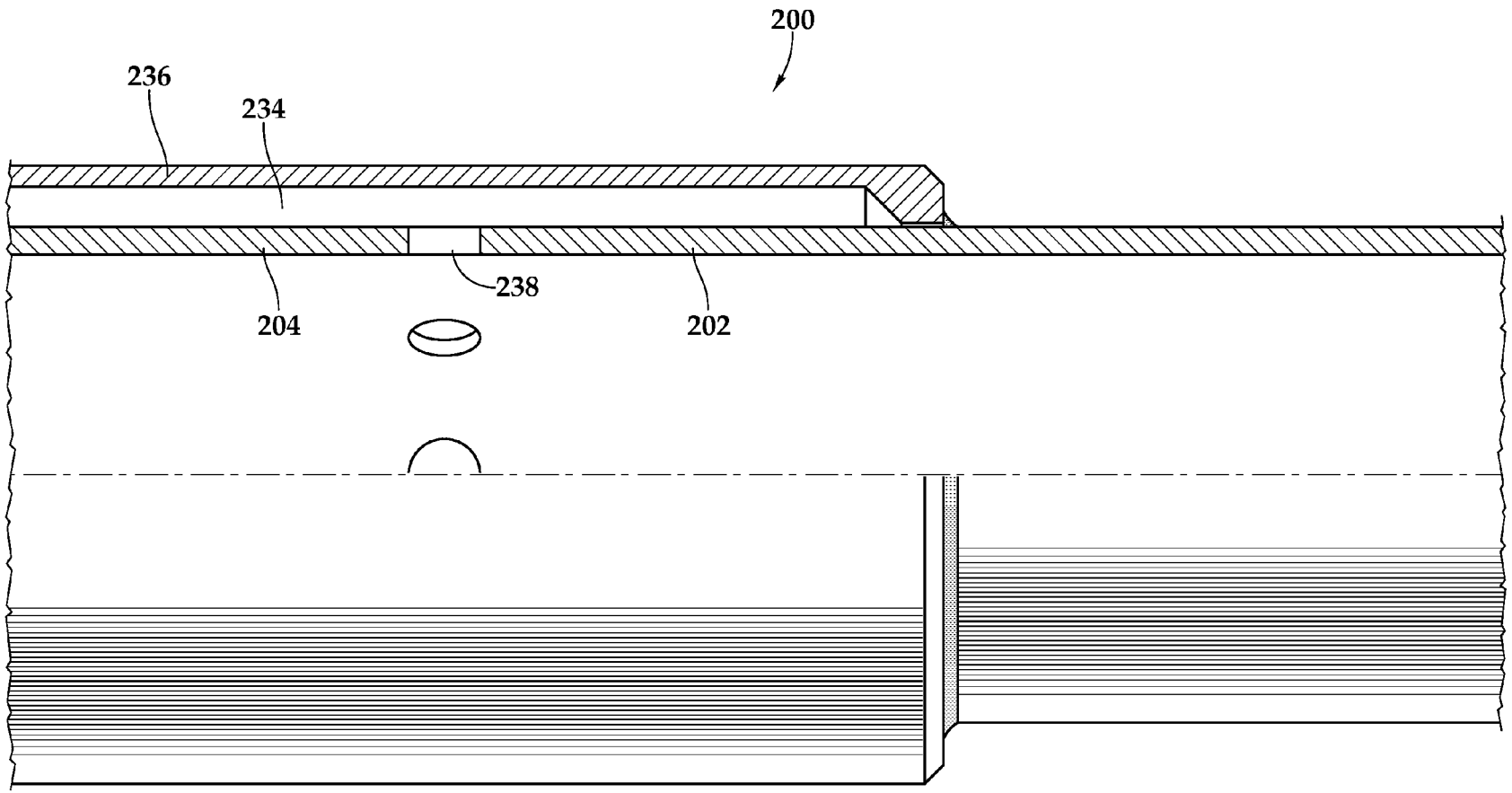

Referring next to FIGS. 3A and 3B, therein are depicted axially-adjacent quarter sectional views of a sand control screen assembly according to the present invention that is representatively illustrated and generally designated 200. As with sand control screen 100 described above, sand control screen assembly 200 may be suitably coupled to other similar sand control screen assemblies, production packers, locating nipples, production tubulars or other downhole tools to form a completions string such as that described above. Sand control screen assembly 200 includes a base pipe 202 having a perforated section 204 and a nonperforated section 206. Positioned around nonperforated section 206 of base pipe 202 is a screen jacket 208 that serves as a filter medium designed to allow fluids to flow therethrough but prevent particulate matter of a predetermined size from flowing therethrough.

In the illustrated embodiment, screen jacket 208 includes a drainage layer 210 formed from a plurality of circumferentially distributed axially extending ribs 212 having a screen wire 214 wrapped around ribs 212 forming a plurality of turns having gaps therebetween. Drainage layer 210 provides stand-off for fluid cross flow between a wire mesh filter medium 216 and base pipe 202. Wire mesh filter medium 216 is preferably formed from a fluid-porous, particulate restricting, metal material such as a plurality of layers of a wire mesh that are sintered, diffusion bond or otherwise operably associated with one another to form a wire mesh screen. In the illustrated embodiment, wire mesh filter medium 216 has three wire mesh layers 218, 220, 222.

Positioned around wire mesh filter medium 216 is a protective outer shroud 224 having an array of regularly-spaced perforations 226 passing therethrough. Outer shroud 224 also has a plurality of dimples 228 that provide stand-off between the inner surface of outer shroud 224 and the outer surface of wire mesh filter medium 216. In the illustrate embodiment, screen jacket 208 is attached to base pipe 202 by a pair of connector rings 230, 232 that are welded to outer shroud 224 and base pipe 202. In contrast to the embodiment shown above in FIG. 2, in which filtered fluid passes through ports 104 disposed in the wall of base pipe 102 behind screen jacket 106, filtered fluid travels via an alternate path within sand control screen assembly 200. In the illustrated embodiment, fluid flows through one or more openings in connector ring 232 or between the outside of base pipe 202 and the inside connector ring 232 into annulus 234 between an outer housing 236 and base pipe 202. Thereafter, the fluid enters the interior of base pipe 202 via ports 238 disposed in the adjacent section of base pipe 202 depicted in FIG. 3B. Sand control screen assembly 200 may include one or more flow control devices (not pictured) disposed within annulus 234 to control the rate of fluid flow therethrough.

As discussed above, the present invention is characterized in such a manner that the array of circumferentially distributed axially extending ribs 212 comprises at least a first set of ribs 240 having certain characteristics and a second set of ribs 242 having different characteristics. For example, the first set of ribs 240 may have a larger nominal diameter in the radial direction than the second set of ribs 242. As another example, the first set of ribs 240 may have a different cross sectional shape than the second set of ribs 242. Preferably, the first set of ribs 240 provides a different stand-off dimension than the second set of ribs 242, as described in further detail below.

The following figures depict cross-sections of several sand control screen assemblies according to alternate embodiments thereof, each including ribs having various characteristics. These figures depict certain particular embodiments and combinations, but those of skill in the art will understand and appreciate that the particular shapes and patterns depicted in the figures are intended only for illustrative purposes, and that many other shapes, features and patterns may be employed in further alternate embodiments.

Figure 4A:
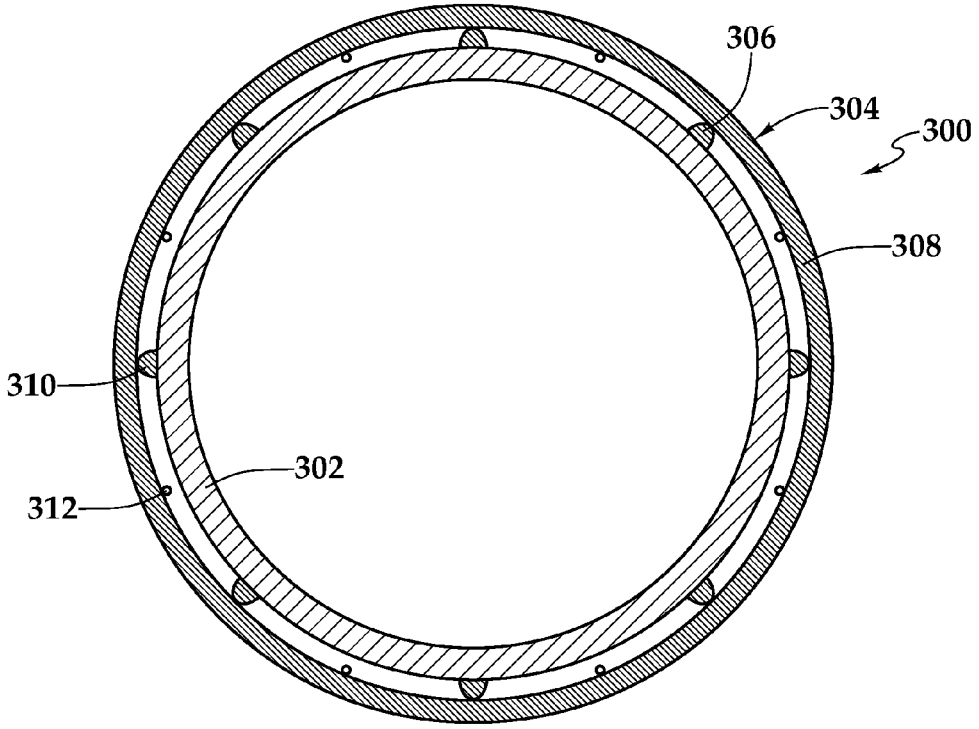
FIGS. 4A-4B are cross-sectional views of a sand control screen assembly according to an embodiment of the present invention.

FIG. 4A depicts a cross-section of screen assembly 300 showing base pipe 302 having a drainage layer 304 of a sand control screen jacket depicted therearound. Drainage layer 304 includes an array of circumferentially distributed axially extending ribs 306 with a wrap wire screen 308 positioned therearound. The array of ribs 306 comprises a first set of ribs 310 and a second set of ribs 312. Each of ribs 310 has a cross-sectional profile characterized by a generally-trapezoidal shape. Those of skill in the art will appreciate that a wide variety of shapes may be employed in place of the generally-trapezoidal shape depicted, including, but not limited to, round, oval, square, rectangular, triangular, polygonal, arcuate and compliant shapes, as examples. The broader inwardly-disposed surface of each rib 310 faces and contacts the outer surface of base pipe 302, while the narrower outwardly-disposed surface of each rib 310 is secured to wrap wire 308 by a suitable method of attachment, such as by welding.

Each of ribs 312 has a cross-sectional profile characterized by a round shape. As above, a wide variety of shapes may be employed in place of the round shape depicted. The outwardly-disposed surface of each rib 312 is secured to wrap wire 308 by a suitable method of attachment, such as by welding. The nominal diameter of ribs 312 in the radial direction relative to the nominal diameter of ribs 310 in the radial direction is such that a gap is formed between the inwardly-facing surface of ribs 312 and the outer surface of base pipe 302. The gap allows for an increased level of compliance and flexibility in the drainage layer 304 that prevents wrinkling, buckling and spreading of wrap wire 308, thereby preventing collapse of the wire mesh filter medium (not pictured) disposed about drainage layer 302 under increased pressures. This design allows a certain amount of radial movement of wrap wire 308 toward base pipe 302 between adjacent pairs of ribs 310 but prevents excessive radial movement due to the presence of ribs 312 between adjacent ribs 310 which not only limits the extend of the radial movement, thereby ensuring a cross flow path for production fluids, as best seen in FIG. 4B, but also provides additional support in the longitudinal direction to the various turns of wrap wire 308.

Figure 4B:
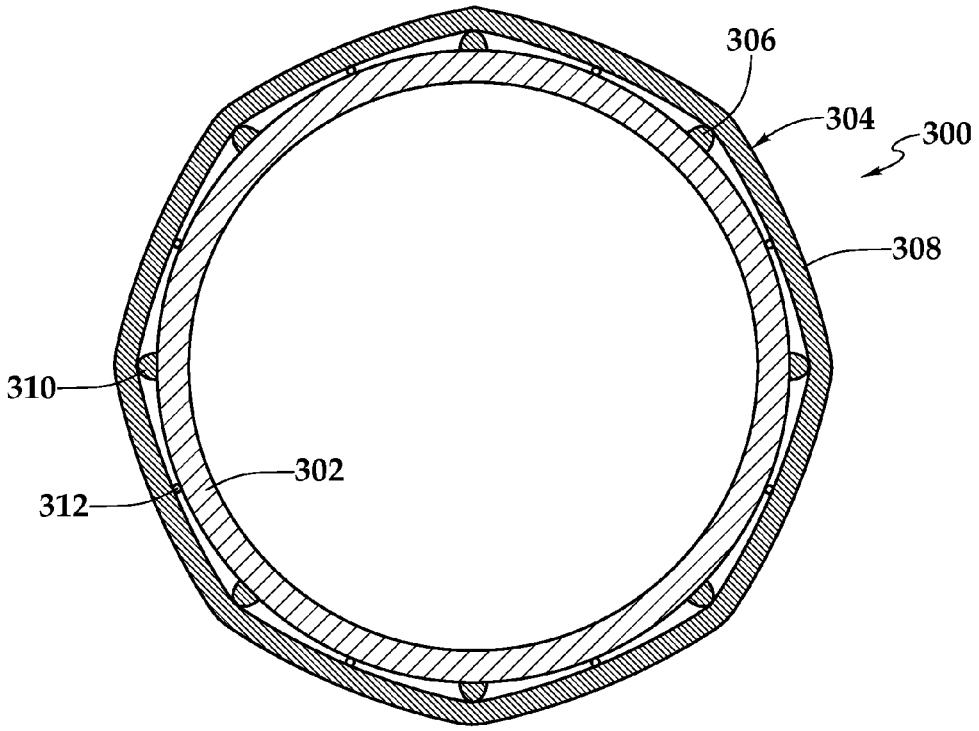

Those of skill in the art will understand and appreciate that the specific details shown in FIGS. 4A-4B are provided only for purposes of illustration of the inventive concept embodied therein. As an example, FIGS. 4A-4B depict eight ribs 310 and eight ribs 312 evenly spaced intermittently and circumferentially about base pipe 302 in a one-to-one relationship, but there is nothing whatsoever within the broader spirit and scope of the present invention limiting the ribs to this particular number or relationship. In alternate embodiments, there may be more or fewer than eight ribs 310 or ribs 312, and there may be more than one rib 310 disposed between each pair of ribs 312. Alternately, there may be more than one rib 310 disposed between each pair of ribs 312. In certain embodiments, there may be more than two types of ribs, each type having different characteristics from the others. In other embodiments, the ribs may not be evenly spaced about the circumference of base pipe 302. These variations and others are squarely within the general spirit and scope of the present invention, as will be readily ascertained by one of skill in the art.

Figure 5A:
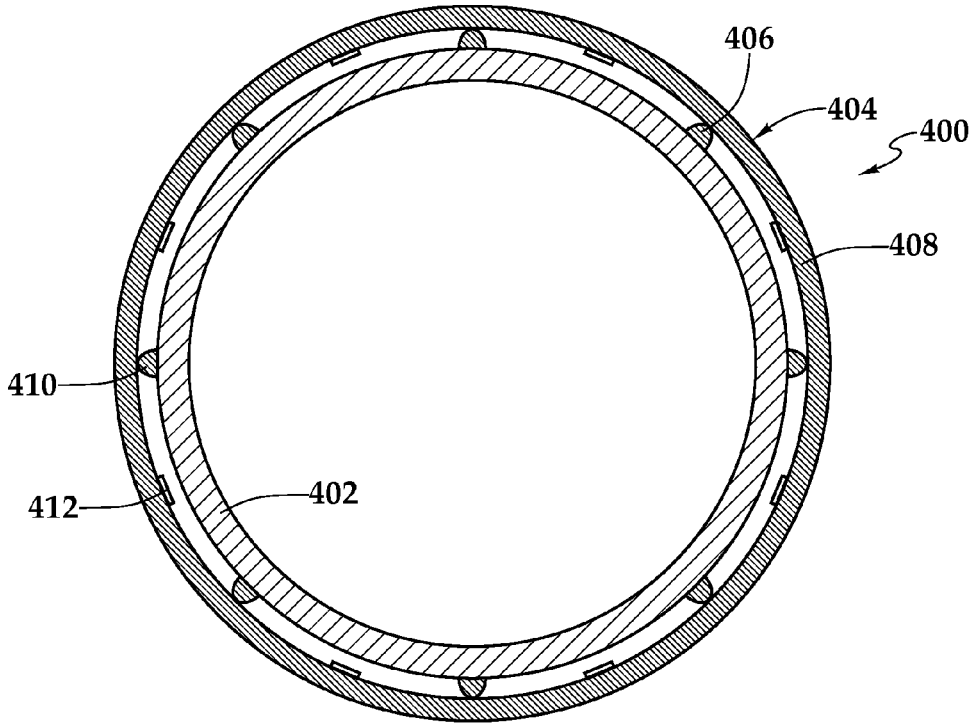
FIGS. 5A-5B are cross-sectional views of a sand control screen assembly according to an embodiment of the present invention.

FIG. 5A depicts a cross-section of screen assembly 400 showing base pipe 402 having a drainage layer 404 of a sand control screen jacket depicted therearound. Drainage layer 404 includes an array of circumferentially distributed axially extending ribs 406 with a wrap wire screen 408 positioned therearound. The array of ribs 406 comprises a first set of ribs 410 and a second set of ribs 412. Each of ribs 410 has a cross-sectional profile characterized by a generally-trapezoidal shape. The broader inwardly-disposed surface of each rib 410 faces and contacts the outer surface of base pipe 402, while the narrower outwardly-disposed surface of each rib 410 is secured to wrap wire 408 by a suitable method of attachment, such as by welding.

Figure 5B:
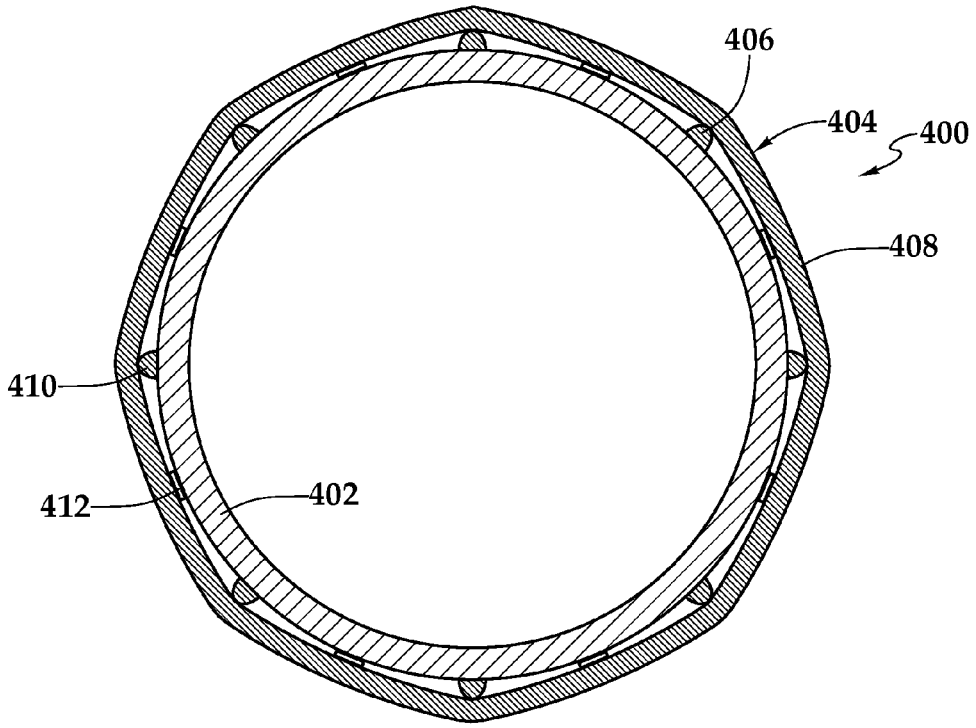

Each of ribs 412 has a cross-sectional profile characterized by a rectangular shape. The outwardly-disposed surface of each rib 412 is secured to wrap wire 408 by a suitable method of attachment, such as by welding. The nominal diameter of ribs 412 in the radial direction relative to the nominal diameter of ribs 410 in the radial direction is such that a gap is formed between the inwardly-facing surface of ribs 412 and the outer surface of base pipe 402. The gap allows for an increased level of compliance and flexibility in the drainage layer 404 that prevents wrinkling, buckling and spreading of wrap wire 408, thereby preventing collapse of the wire mesh filter medium (not pictured) disposed about drainage layer 402 under increased pressures. This design allows a certain amount of radial movement of wrap wire 408 toward base pipe 402 between adjacent ribs 410 but prevents excessive radial movement due to the presence of ribs 412 between adjacent pairs of ribs 410 which not only limits the extend of the radial movement, thereby ensuring a cross flow path for production fluids, as best seen in FIG. 5B, but also provides additional support in the longitudinal direction to the various turns of wrap wire 408.

Figure 6A:
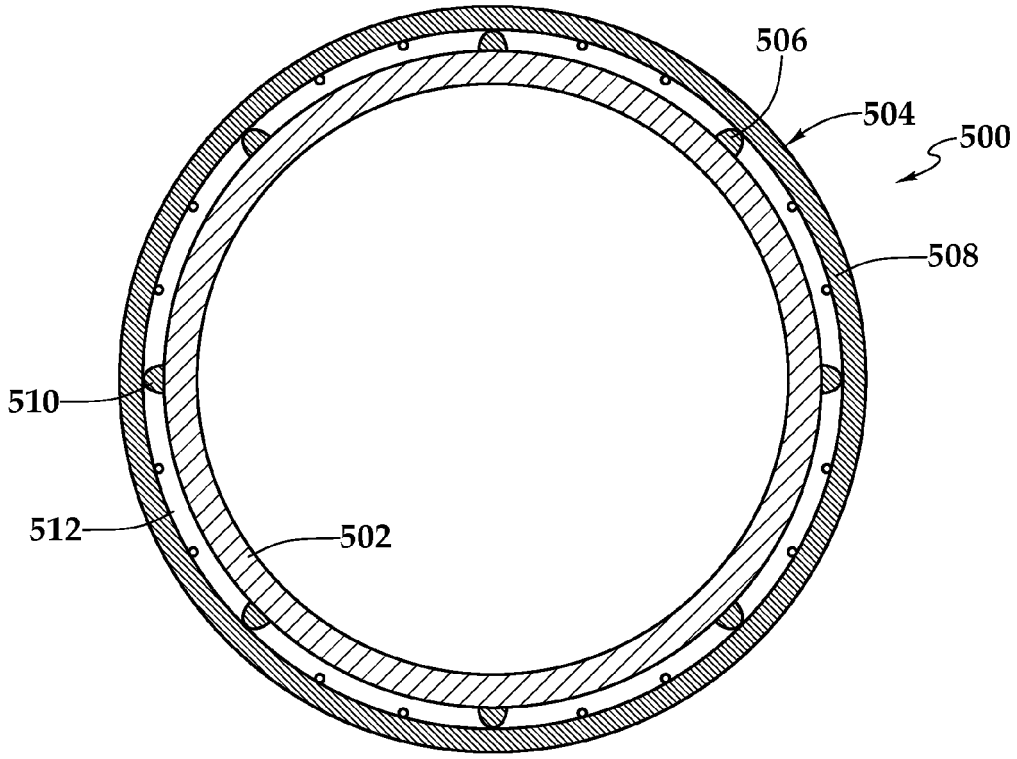
FIGS. 6A-6B are cross-sectional views of a sand control screen assembly according to an embodiment of the present invention.

FIG. 6A depicts a cross-section of screen assembly 500 showing base pipe 502 having a drainage layer 504 of a sand control screen jacket depicted therearound. Drainage layer 504 includes an array of circumferentially distributed axially extending ribs 506 with a wrap wire screen 508 positioned therearound. The array of ribs 506 comprises a first set of ribs 510 and a second set of ribs 512. Each of ribs 510 has a cross-sectional profile characterized by a generally-trapezoidal shape. The broader inwardly-disposed surface of each rib 510 faces and contacts the outer surface of base pipe 502, while the narrower outwardly-disposed surface of each rib 510 is secured to wrap wire 508 by a suitable method of attachment, such as by welding.

Figure 6B:
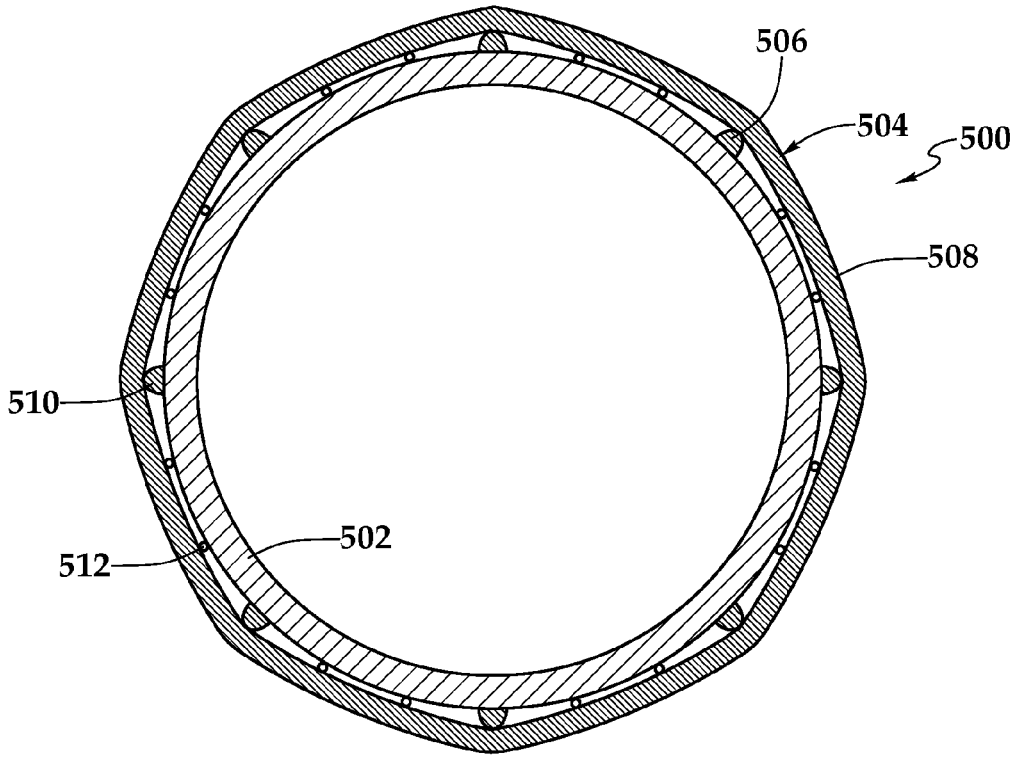

Each of ribs 512 has a cross-sectional profile characterized by a round shape. The outwardly-disposed surface of each rib 512 is secured to wrap wire 508 by a suitable method of attachment, such as by welding. Although the cross-sectional profiles of the ribs 510, 512 are similar to ribs 310, 312 shown in FIG. 4A, the embodiment shown in FIG. 6A differs in that there are multiple ribs 512 disposed between each pair of ribs 510. The nominal diameter of ribs 512 in the radial direction relative to the nominal diameter of ribs 510 in the radial direction is such that a gap is formed between the inwardly-facing surface of ribs 512 and the outer surface of base pipe 502. The gap allows for an increased level of compliance and flexibility in the drainage layer 504 that prevents wrinkling, buckling and spreading of wrap wire 508, thereby preventing collapse of the wire mesh filter medium (not pictured) disposed about drainage layer 502 under increased pressures. This design allows a certain amount of radial movement of wrap wire 508 toward base pipe 502 between adjacent ribs 510 but prevents excessive radial movement due to the presence of the pair of ribs 512 between adjacent pairs of ribs 510 which not only limits the extend of the radial movement, thereby ensuring a cross flow path for production fluids, as best seen in FIG. 6B, but also provides additional support in the longitudinal direction to the various turns of wrap wire 508.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A sand control screen assembly comprising:

a base pipe having at least one opening in a sidewall thereof; and a screen jacket positioned exteriorly about the base pipe, the screen jacket including a drainage layer and a filter medium positioned exteriorly about the drainage layer, the drainage layer including a plurality of circumferentially distributed axially extending first ribs, a plurality of circumferentially distributed axially extending second ribs and a wrap wire securably attached exteriorly to the first ribs and the second ribs forming a plurality of turns having gaps therebetween, wherein the first ribs contact the base pipe and have a first nominal diameter that provides a first stand-off dimension between the wrap wire and the base pipe at the locations of the first ribs; and wherein, the second ribs having a second nominal diameter that is less than the first nominal diameter such that, in a first configuration of the drainage layer, the second ribs form gaps with the base pipe and, in a second configuration of the drainage layer, the second ribs contact the base pipe to provide a second stand-off dimension, that is less than the first stand-off dimension, between the wrap wire and the base pipe at the locations of the second ribs.

2. The sand control screen assembly as recited in claim 1 wherein the screen jacket is positioned about a perforated section of the base pipe.

3. The sand control screen assembly as recited in claim 1 wherein the screen jacket is positioned about a nonperforated section of the base pipe.

4. The sand control screen assembly as recited in claim 1 wherein the filter medium further comprises a wire mesh filter medium.

5. The sand control screen assembly as recited in claim 1 wherein the first ribs have a generally-trapezoidal cross-sectional rib profile and the second ribs have a circular cross-sectional rib profile.

6. The sand control screen assembly as recited in claim 1 wherein the first ribs have a generally-trapezoidal cross-sectional rib profile and the second ribs have a rectangular cross-sectional rib profile.

7. The sand control screen assembly as recited in claim 1 wherein at least one second rib is circumferentially located between each adjacent pair of first ribs.

8. The sand control screen assembly as recited in claim 1 wherein at least two second ribs are circumferentially located between each adjacent pair of first ribs.

* * * * *